US006806792B2

(12) United States Patent
Penn

(10) Patent No.: US 6,806,792 B2
(45) Date of Patent: Oct. 19, 2004

(54) BROADBAND, FOUR-BIT, MMIC PHASE SHIFTER

(75) Inventor: John E. Penn, Eldersburg, MA (US)

(73) Assignee: The Johns Hopkins University, Baltimore, MD (US)

( * ) Notice: Subject to any disclaimer, the term of this patent is extended or adjusted under 35 U.S.C. 154(b) by 0 days.

(21) Appl. No.: 10/136,019

(22) Filed: Apr. 30, 2002

(65) Prior Publication Data

US 2002/0158710 A1 Oct. 31, 2002

Related U.S. Application Data

(60) Provisional application No. 60/287,596, filed on Apr. 30, 2001, and provisional application No. 60/287,597, filed on Apr. 30, 2001.

(51) Int. Cl.[7] ..... H01P 1/18

(52) U.S. Cl. ..... 333/164; 333/139; 342/361

(58) Field of Search ..... 333/138, 139, 333/164; 342/368, 372, 374, 361, 362, 363

(56) References Cited

U.S. PATENT DOCUMENTS 4,458,219 A * 7/1984 Vorhaus ..... 333/164
6,020,848 A * 2/2000 Wallace et al. ..... 342/362
6,078,223 A * 6/2000 Romanofsky et al. ..... 331/9
6,137,377 A * 10/2000 Wallace et al. ..... 333/139
6,242,990 B1 * 6/2001 Sokolov ..... 332/103
6,317,075 B1 * 11/2001 Heide et al. ..... 342/128

* cited by examiner

*Primary Examiner*—Timothy P. Callahan
*Assistant Examiner*—An T. Luu
(74) *Attorney, Agent, or Firm*—Francis A. Cooch

(57) ABSTRACT

A broadband, 4-bit MMIC phase shifter for use in a phased array antenna is provided. The four bit selectable phase shifter for use in a phased array antenna of the present invention, which selectably causes an input signal to be shifted in phase, includes a first bit for selectively providing a 180° phase shift, wherein the first bit is a line/reflected bit; a second bit for selectively providing a 90° phase shift, wherein the second bit is a reflected bit; a third bit for selectively providing a 45° phase shift, wherein the third bit is a reflected bit; and a fourth bit for selectively providing a 22.5° phase shift, wherein the fourth bit is a high pass/low pass bit. The phase shifter of the present invention is compact, broadband and has good insertion loss and balance, yet uses a standard 0.25 mm PHEMT process with standard bias voltages.

10 Claims, 5 Drawing Sheets

BROADBAND, FOUR-BIT, MMIC PHASE SHIFTER

CROSS-REFERENCE TO RELATED APPLICATIONS

This application claims priority to U.S. Provisional Application No. 60/287,596, filed on Apr. 30, 2001, entitled "Ka-Band Digital Phase Shifter MMIC" and U.S. Provisional Application No. 60/287,597, filed on Apr. 30, 2001, entitled "Ka-band Efficient Power Amplifier MMIC" of John E. Penn. The contents of the aforesaid U.S. Provisional Application 60/287,596 and 60/287,597 are hereby incorporated by reference.

STATEMENT OF GOVERNMENTAL INTEREST

This invention was made with Government support under Contract No. NAS5-97271 awarded by the National Aeronautics & Space Administration. The Government has certain rights in the invention.

BACKGROUND OF THE INVENTION

1. Field of the Invention

The present invention relates generally to monolithic microwave integrated circuit (MMIC) design, and in particular, to a broadband, 4-bit MMIC phase shifter for use in a phased array antenna employed in radar or communication systems to point or steer an RF (Radio Frequency) beam.

2. Description of the Related Art

In the prior art, a phase shifter is employed as one of the component circuits of a phased array antenna and the like. FIG. 1 is a block diagram schematically showing the configuration of a prior art phased array antenna. In the figure, a phased array antenna 200 includes a plurality of antenna elements 211, 212, 213, and 214. The antenna 200 changes the direction D of an incoming or outgoing electromagnetic wave by controlling the phase of the electromagnetic waves in the antenna elements 211, 212, 213, and 214. FIG. 1 shows a phased array antenna which has four antenna elements for simplicity of description. Typically, there are more than four antenna elements in an actual phased array antenna.

The antenna 200 includes amplifiers 221, 222, 223, and 224, all of which amplify microwaves going out from or coming into the corresponding antenna elements 211, 212, 213, and 214, and phase circuits 231, 232, 233, and 234, all of which shift the phases of microwaves going out from or coming into the corresponding antenna elements 211, 212, 213, and 214. The phase circuits 231, 232, 233, and 234 are connected to a signal source 260 and a signal receiver 270 via corresponding directional couplers 251, 252, 253, and 254.

The antenna 200 also includes a control circuit 240 which controls the phase circuits and the directional couplers. More specifically, the control circuit 240 controls the phase shift of the phase circuits 231, 232, 233, and 234 with 5-bit control signals Pc1, Pc2, Pc3, and Pc4, respectively, and switches the connection of each phase circuit to the signal source 260 or to the signal receiver 270 with a control signal Kc.

FIG. 2 shows the specific configuration of the phase circuit having input and output terminals 23*a* and 23*b*, respectively. As shown in FIG. 2, each of the phase circuits 231, 232, 233, and 234 of FIG. 1 comprises five switched-line phase shifters 230*a*, 230*b*, 230*c*, 230*d*, and 230*e*, all of which provide different phase shifts. The phase shift is defined as the difference in phase between signals at the phase shifter output and input. In the phase circuit so constructed, the phase of microwave input can be varied in steps of 11.25° in the range of from 11.25° to 348.75° using a 5-bit control signal.

Referring back to FIG. 1, the traveling direction of the microwaves radiated by the antenna 200 is a direction D that is perpendicular to a wavefront W. The wavefront W consists of parts having the same phase in the microwave signals radiated from the antenna elements. In other words, microwaves are radiated from the antenna 200 in the direction D. The radiation direction D depends on the phase shift set by the control signals Pc1, Pc2, Pc3, and Pc4 in the phase circuits 231, 232, 233, and 234.

Increasing carrier frequencies in communications systems offer greater data transmission rates. Changing from X-band (8 GHz) to Ka-band (32 GHz) has the potential for a sixteen fold improvement in data rates for a given antenna size and transmitter power. In deep space missions, where the available DC power is limited, improving the amount of data returned in a given mission is of great interest.

The phase shifter is a key component in a phased array system. However, designing at Ka-band frequencies, especially regarding phase, is much harder than at lower frequencies. An error in line length amounting to 5° at X-band (8 GHz) becomes a 20° error at Ka-band (32 GHz). Modeling errors in switch devices, microstrip or MMIC components accumulate quickly. Conventional switching devices are far from ideal at Ka-band.

Additional factors must be considered when designing high frequency phase shifters. For example, design tradeoffs for insertion loss, insertion balance between phase states and phase accuracy must be made. Further, each bit of the phase shifter uses a topology or circuit architecture appropriate for that particular phase shift, however, a topology that works well for large phase shifts may be inappropriate or inefficient for small phase shifts. Additionally, parasitic capacitances in the switches must be compensated for, or incorporated into, the phase shifter topology.

SUMMARY OF THE INVENTION

It is, therefore, an object of the present invention to provide a broadband (Ka-band) MMIC phase shifter.

It is another object of the present invention to provide a broadband phase shifter which reduces the effect of parasitic capacitances in the switching elements.

The foregoing and other objects of the present invention are achieved by providing a broadband, 4-bit MMIC phase shifter. Rather than use exotic GaAs processing techniques to reduce the effects of parasitic capacitances in the switch elements, a standard pseudomorphic high electron mobility transistor (PHEMT) process is used, with phase shift architectures chosen to absorb the parasitic effects for broadband operation. Careful analysis of linear and EM simulations in combination with measured results has resulted in an improved four-bit design that is compact, broadband and has good insertion loss and balance, yet uses a standard 0.25 mm PHEMT process with standard bias voltages.

The four-bit selectable phase shifter for use in a phased array antenna of the present invention, which selectably causes an input signal to be shifted in phase, includes a first bit for selectively providing a 180° phase shift, wherein the first bit is a line/reflected bit; a second bit for selectively providing a 90° phase shift, wherein the second bit is a reflected bit; a third bit for selectively providing a 45° phase shift, wherein the third bit is a reflected bit; and a fourth bit for selectively providing a 22.5° phase shift, wherein the fourth bit is a high pass/low pass bit.

BRIEF DESCRIPTION OF THE DRAWINGS

The above and other objects, features and advantages of the present invention will become more apparent from the following detailed description when taken in conjunction with the accompanying drawings in which.

DETAILED DESCRIPTION OF THE PREFERRED EMBODIMENTS

Preferred embodiments of the present invention will be described hereinbelow with reference to the accompanying drawings. In the following description, well-known functions or constructions are not described in detail since they would obscure the invention in unnecessary detail.

The broadband phase shifter of the present invention includes a 4-bit topology where each bit uses a topology or circuit architecture for a particular phase shift. The present invention employs a unique combination of bit topologies which work well at Ka-band frequencies. The bit topologies utilize specific components which allow the phase shifter to compensate for parasitic capacitances. The detailed description below will first explain the components used to create the individual bit topologies and then will explain the individual bit topologies utilized to assemble the broadband phase shifter of the present invention.

PHEMT Switches

The switching elements used in the phase shifter of the present invention are made from 0.25 mm PHEMT (pseudomorphic high electron mobility transistor) devices. The two states of a switch are ON, usually defined by a gate bias of 0V, and OFF, usually defined by a gate bias of at least 2 to 4 times the pinchoff voltage of the device. Small signal operation of the phase shifter is desired to minimize distortion. An ideal switch should toggle between a short circuit and an open circuit. In reality, a PHEMT switch looks like a resistance in the ON state and a parasitic capacitance in the OFF state. The larger the device, the smaller the ON state resistance. Unfortunately, the OFF state capacitance should be very small, necessitating a small device, which conflicts with the previous requirement. This OFF state capacitance must be compensated for, particularly at Ka-band frequencies. It can be absorbed or incorporated into the phase shifter topology, or it can be compensated for with an inductance, which may lead to a design with a narrow band response.

Lange Coupler

Lange couplers are not often used in MMICs because their quarter wave (¼) length size can be quite large. At Ka-band frequencies and above, quarter wave size components can reasonably fit on a MMIC. For the intended outer space communications application, performance is more important than GaAs die size. Using Agilent EEsof's Libra simulator and Linecalc program (conventional MMIC design software programs), the coupler's line width, line spacing and overall length is chosen. Preferably, the width and spacing of the Lange coupler is approximately 10 um and the length is ¼ wavelength in GaAs at 32 GHz.

Figure 1:
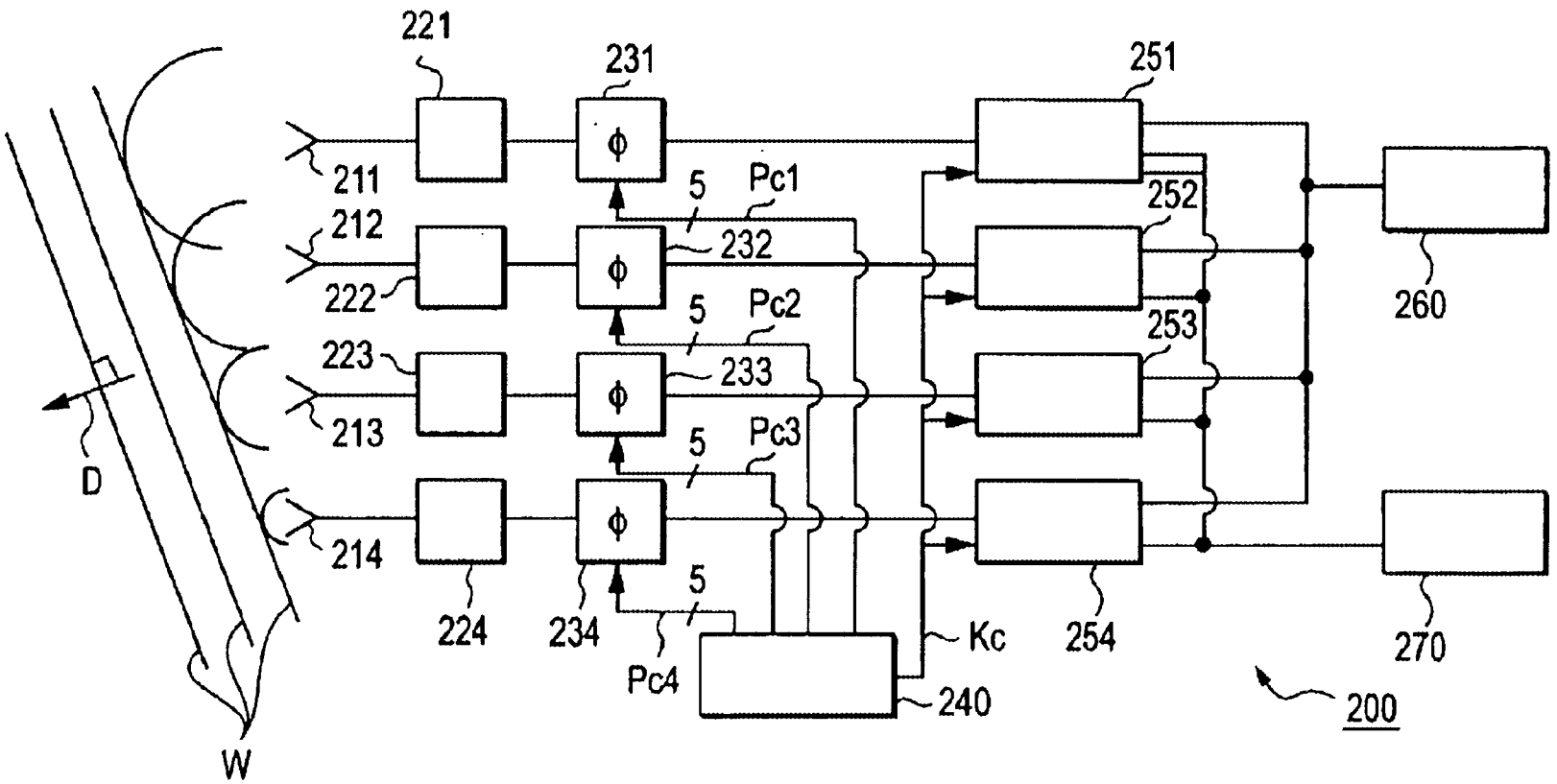
FIG. 1 PRIOR ART
FIG. 1 is a schematic diagram illustrating a prior art phased array antenna.
Figure 2:
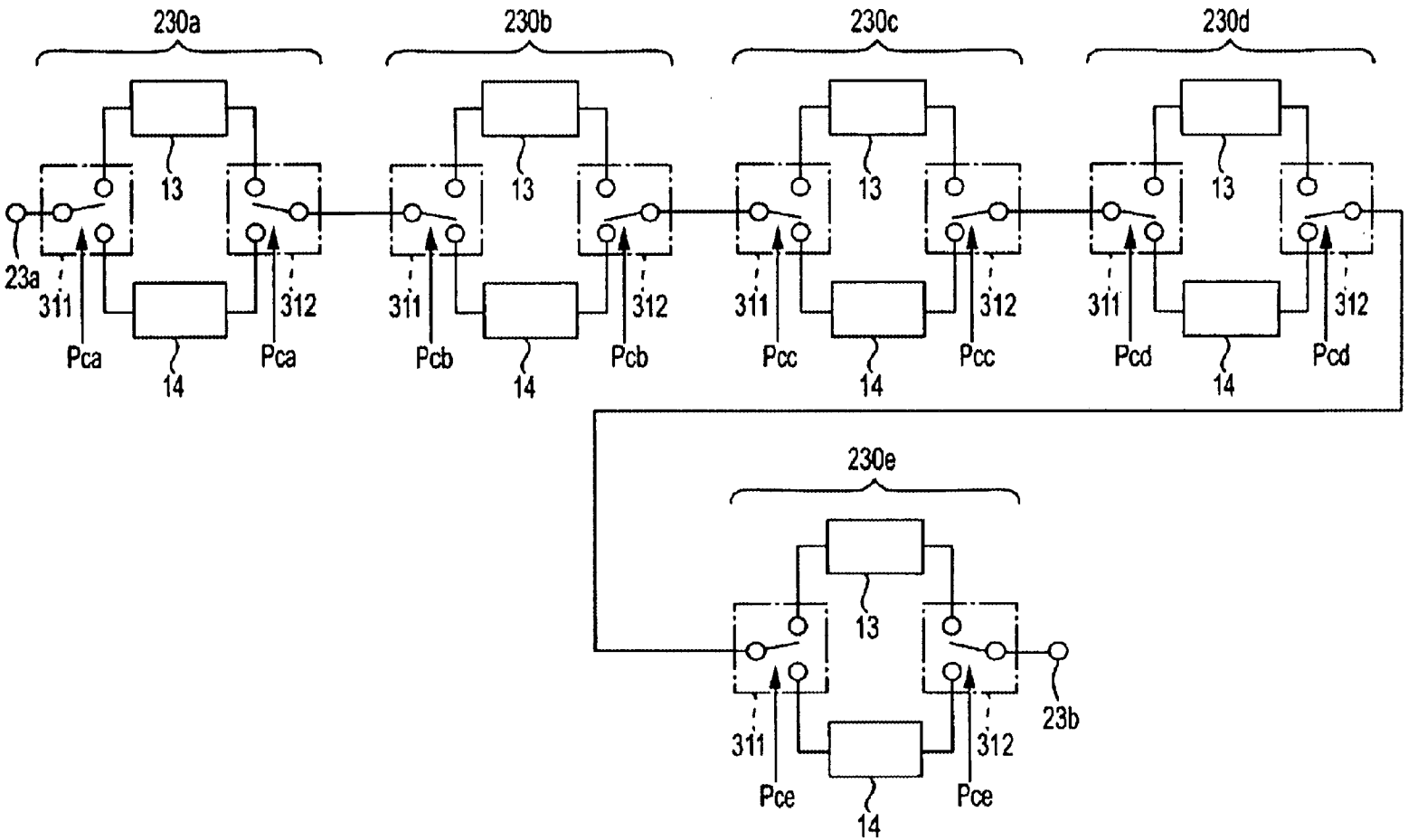
FIG.2 PRIOR ART
FIG.2 is a schematic diagram of a phase circuit of the prior art phased array antenna shown in FIG. 1.
Figure 3:
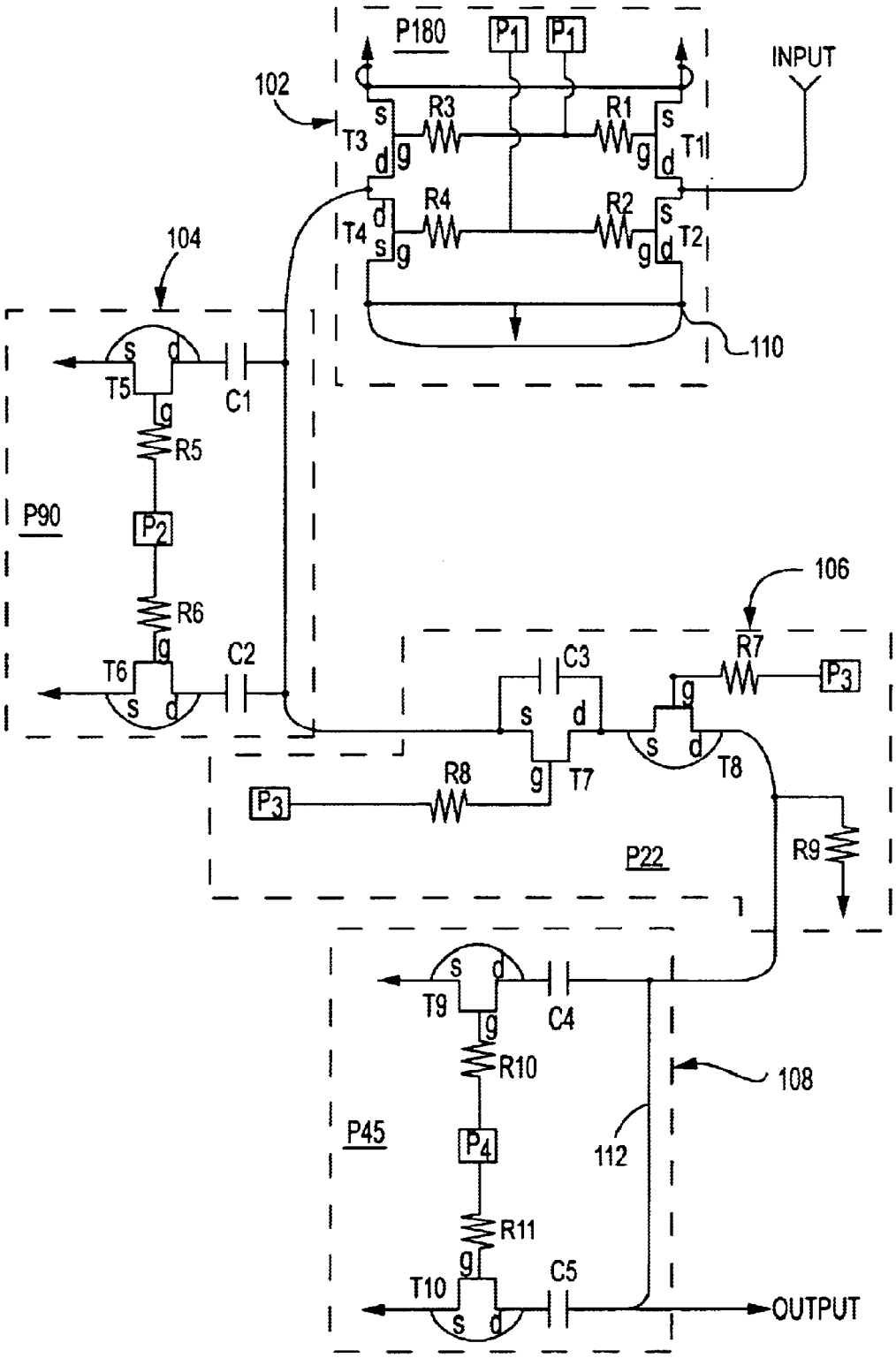
FIG. 3 is a schematic diagram of a broadband, four-bit phase shifter in accordance with the present invention.

Referring to FIG. 3, the phase shifter 100 of the present invention is shown. The phase shifter 100 generally comprises a 4-bit topology wherein each bit shifts the phase of an input signal INPUT to produce an output signal OUTPUT at a desired phase shift from the phase of the input signal. The 4 bits include a 180° line/reflected bit 102, a 90° reflected bit 104, a 45° reflected bit 108 and a 22.5° high pass/low pass bit 106. Each bit will now be described in detail below.

180° Line/Reflected Bit

For large phase shifts, a broadband switched line/reflected bit 102 is used. The line/reflected bit 102 comprises four PHEMT switches T1, T2, T3, T4 with resistors R1, R2, R3, R4 connected to the gate of each PHEMT switch. Two pairs of the PHEMT switches T1/T2 and T3/T4 are configured in identical configurations and then connected by Lange coupler 110. The Lange coupler 110 connected to substrate vias provides a relatively broadband 180° phase shift. Switching between a ¼ line and an equal length Lange coupler shorted to ground provides a broadband 180° phase difference. Tuning inductances at each PHEMT switch compensate for the switch's OFF state capacitances. Control voltages P1, notP1 caused bit 102 to shift the phase of the input signal either 0° or 180°.

90° Reflected Bit

The 90° reflected bit 104 was designed with a reflected bit topology as opposed to the switched line/reflected bit topology. While the insertion balance mismatch for the reflected bit topology 104 increases with increased phase shift, this topology produces a 90° bit with relatively low design risk. The insertion balance mismatch is approximately 0.7 dB for the 90° reflected bit. A tradeoff of bandwidth, phase balance, and insertion balance mismatch results in the 0.7 dB mismatch in order to retain good phase balance over a very broad band (16–20 GHz). The bit is controlled by control signal P2.

45° Reflected Bit

For moderate phase shifts, i.e., 45° phase shifts, a broadband reflected bit topology 108 is used. A Lange coupler 112 attached to a tuned switching element provides the phase shift. Each reflected bit consists of a PHEMT switch T9,T10, a capacitor C4,C5 and a tuned inductor. The values are optimized to provide a broadband phase shift while minimizing insertion loss and maintaining insertion balance between the phase states.

Ideally, all the RF energy would be reflected at the coupled ports of the Lange coupler to the isolated port forming the through path of the phase shifter bit. The PHEMT switch size is primarily chosen for phase shift differential with a trade-off for insertion balance. A larger PHEMT switch tends to improve the insertion balance while reducing the differential phase shift. The values of the inductors, capacitors and PHEMTs are selected by optimizing the trade-offs between bandwidth, insertion loss and insertion balance.

The Lange coupler in this reflected bit topology provides a broadband match due to the symmetry of the loads. This bit is controlled by control signal P4.

22.5° High Pass/Low Pass Bit

For small phase shifts, a high pass/ low pass bit topology 106 is used. High pass/low pass networks work well in MMICs since they tend to be small in size and are broadband. There are many topologies for high pass/low pass networks. The topology chosen, which includes a FET switch T7 and PHEMT switch T8 connected in parallel, absorbs the parasitic capacitances of the switches by incorporating them as elements in the high pass/low pass architecture. Additionally, a bias resistor R9 (1 to 2 kΩ) is connected from the PHEMT switch T8 drain to ground to avoid a floating bias potential. While the differential phase shift tends to be broadband for this topology, it can be difficult to balance the insertion loss between phase states. This bit is controlled by control signals P3 and not P3.

Figure 4A:
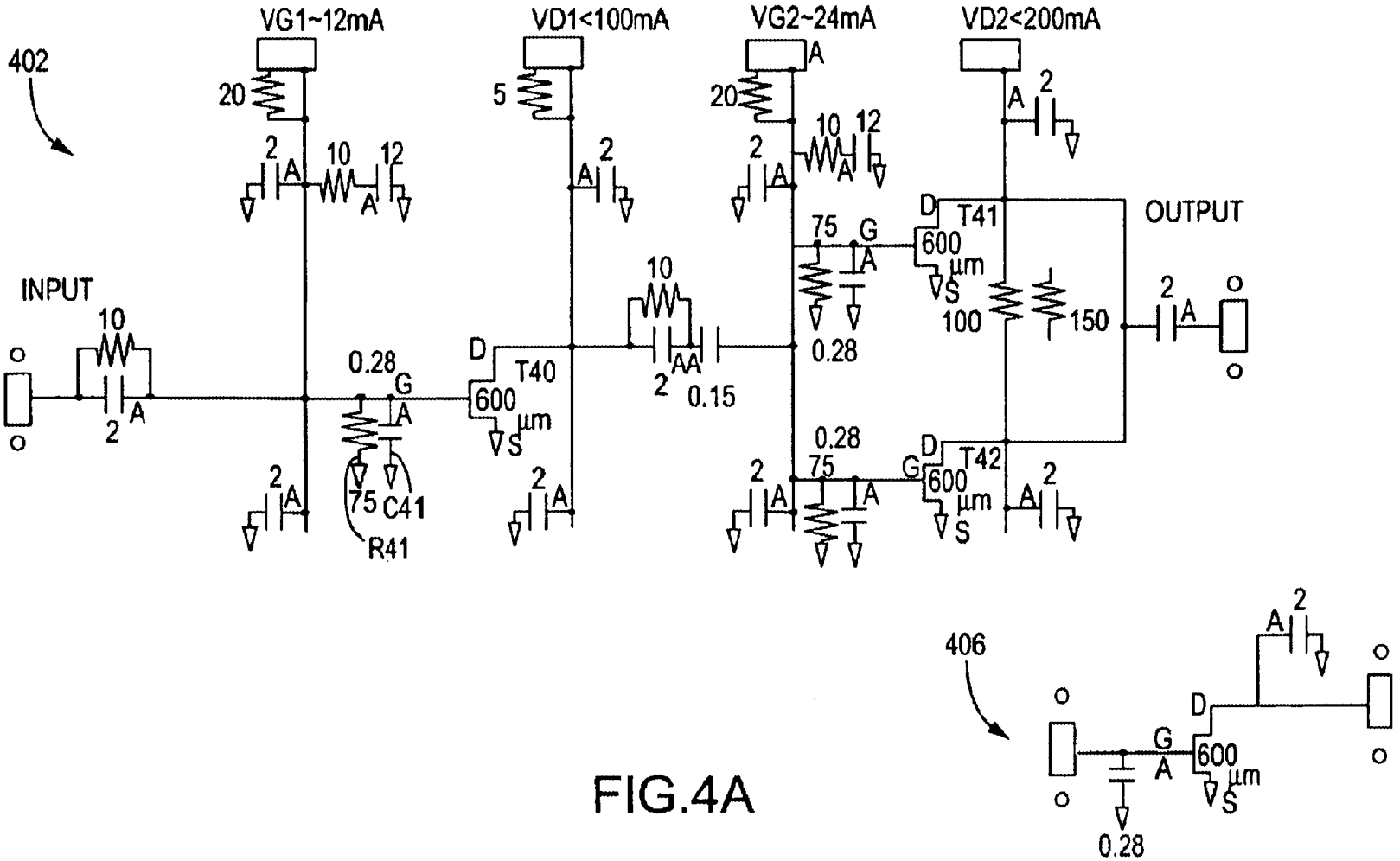
FIG. 4A and 4B illustrate two configurations of new and improved power amplifiers to be used in conjunction with the four-bit phase shifter in accordance with the present invention.
Figure 4B:
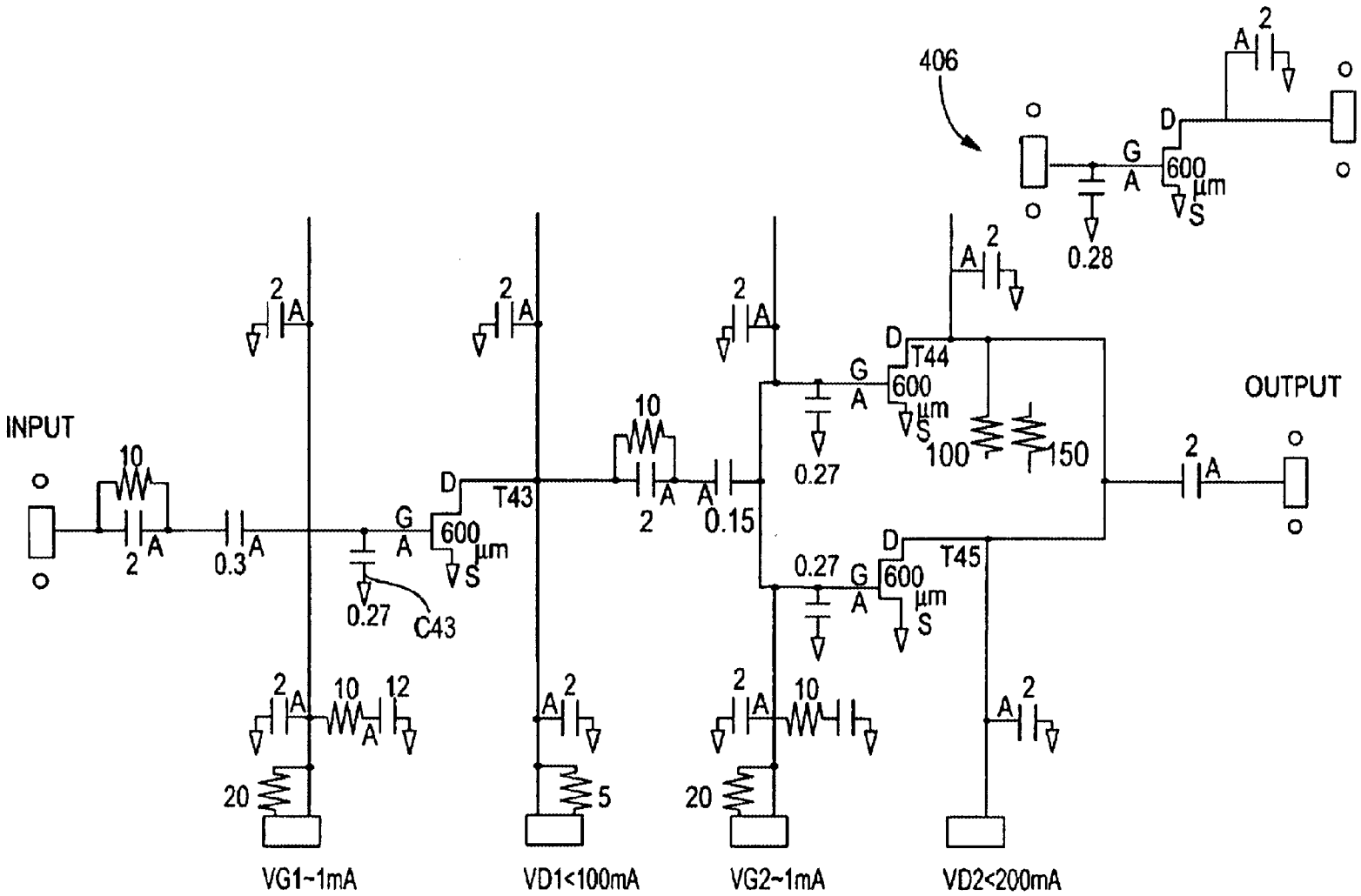

FIGS. 4A and 4B illustrate two configurations of new and improved power amplifiers 402, 404 used in conjunction with the four-bit phase shifter 100 in accordance with the present invention. Standard sized 0.25 $\mu$m PHEMT switching devices are employed in the amplifier designs. Tuning capability is included in both designs to allow a tuning range of plus or minus 3 GHz.

In the design of the power amplifiers 402, 404, a critical matching element is a shunt capacitor to a ground via immediately preceding the PHEMTs. The capacitor on top of a via is a relatively large structure and is needed to be as close to the PHEMT switch T40 as possible. The shunt capacitance value and placement is important. For the first design 402, a shunt resistor R41 for stability is in parallel with the shunt capacitor C41 to ground. However, the simple shunt capacitor/shunt resistor structure causes a low pass roll-off of the amplifier such that it would not have gain above 2–28 GHz.

The second amplifier 404 utilizes a shunt capacitor C43 preceding the PHEMT switch T43 for initial matching but without the shunt-stabilizing resistor to avoid the gain roll-off problem. Amplifier 404 reflects an increased instability risk while amplifier 402 runs the risk of being stable but not having gain at 32 GHz.

For the amplifiers to be stable, each stage must be stable. Since there are two devices in parallel on the output stage (T41, T42 for amplifier 402; T44, T45 for amplifier 404), there exists the possibility of odd mode oscillations. For normal stability, the single stability parameter MU was used to verify each stage including the overall two stage amplifier.

The amplifiers 402, 404 of the present invention achieved ½ watt or more output power at Ka-band with 7 to 8 V of drain supply voltage and a power added efficiency of approximately 29%.

A broadband four-bit GaAs phase shifter at Ka-band frequencies has been described. Broadbanding of the phase shifter bits not only makes the design of the present invention useful in more systems, it increases the tolerance of the design to GaAs processing variations. While the intended application of this phase shifter is a deep space mission, its broadband operation makes it applicable to LMDS communications, radar, satellite communications and other Ka-band systems. This Ka-band phase shifter MMIC uses a standard commercial 0.25 mm PHEMT process allowing for easy reproducibility and manufacture.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A four bit selectable phase shifter for use in a phased array antenna, the phase shifter selectably causing an input signal to be shifted in phase, said phase shifter comprising:

a first bit for selectively providing a 180° phase shift, wherein said first bit is a line/reflected bit;

a second bit for selectively providing a 90° phase shift, wherein said second bit is a reflected bit;

a third bit for selectively providing a 45° phase shift, wherein said third bit is a reflected bit; and a fourth bit for selectively providing a 22.5° phase shift, wherein said fourth bit is a high pass/low pass bit.

2. A four bit selectable phase shifter as in claim 1, wherein said first bit comprises two reflected pairs of FET see "723", "590", "075" patent PHEMT switches coupled together by a Lange coupler.

3. A four bit selectable phase shifter as in claim 1, wherein said first bit is controlled by a first control signal and a second control signal, the second control signal being a negative value of the first control signal.

4. A four bit selectable phase shifter as in claim 1, wherein said second bit comprises a reflected pair of PHEMT switches.

5. A four bit selectable phase shifter as in claim 1, wherein said second bit is controlled by a third control signal.

6. A four bit selectable phase shifter as in claim 1, wherein said third bit comprises a reflected pair of PHEMT switches coupled together by a Lange coupler.

7. A four bit selectable phase shifter as in claim 1, wherein said third bit is controlled by a fourth control signal.

8. A four bit selectable phase shifter as in claim 1, wherein said fourth bit comprises a FET switch coupled in parallel with a PHEMT switch.

9. A four bit selectable phase shifter as in claim 8, wherein said fourth bit further comprises a bias resistor connected from a drain of the PHEMT switch to ground to avoid a floating bias potential.

10. A four bit selectable phase shifter as in claim 1, wherein said fourth bit is controlled by a fifth control signal and a sixth control signal, the sixth control signal being a negative value of the fifth control signal.

* * * * *

UNITED STATES PATENT AND TRADEMARK OFFICE

CERTIFICATE OF CORRECTION

PATENT NO. : 6,806,792 B2
DATED : October 19, 2004
INVENTOR(S) : John E. Penn

It is certified that error appears in the above-identified patent and that said Letters Patent is hereby corrected as shown below:

Title page,
Item [75], Inventors, delete "MA" and insert therefor -- MD --

Signed and Sealed this

First Day of February, 2005

JON W. DUDAS
*Director of the United States Patent and Trademark Office*